US010315808B2

(12) United States Patent
Taylor et al.

(10) Patent No.: US 10,315,808 B2
(45) Date of Patent: Jun. 11, 2019

(54) CONTAINER CLOSURE CAP AND CONTAINER CLOSURE

(71) Applicant: GREIF INTERNATIONAL HOLDING BV, Vreeland (NL)

(72) Inventors: Dale Taylor, Hamilton, IN (US); Cornelis Van De Klippe, West Chicago, IL (US); Steven Talaga, South Elgin, IL (US)

(73) Assignee: GREIF INTERNATIONAL HOLDING BV, Vreeland (NL)

( * ) Notice: Subject to any disclaimer, the term of this patent is extended or adjusted under 35 U.S.C. 154(b) by 78 days.

(21) Appl. No.: 15/338,151

(22) Filed: Oct. 28, 2016

(65) Prior Publication Data

US 2017/0121064 A1 May 4, 2017

Related U.S. Application Data

(60) Provisional application No. 62/247,651, filed on Oct. 28, 2015.

(51) Int. Cl.

| | |
|---|---|
| ***B65D 39/08*** | (2006.01) |
| ***B65D 41/46*** | (2006.01) |
| ***B65D 41/58*** | (2006.01) |
| ***B65D 51/18*** | (2006.01) |
| ***B65D 55/08*** | (2006.01) |

(52) U.S. Cl.

CPC ..... *B65D 41/58* (2013.01); *B65D 39/08* (2013.01); *B65D 41/46* (2013.01); *B65D 51/18* (2013.01); *B65D 55/0818* (2013.01); *B65D 2101/0023* (2013.01); *B65D 2251/0015* (2013.01); *B65D 2251/0075* (2013.01)

(58) Field of Classification Search

CPC ..... B65D 51/18; B65D 41/47; B65D 39/082; B65D 41/17; B65D 41/083; B65D 2251/0075; B65D 2251/0015; B65D 2101/0038; B65D 2101/0023

See application file for complete search history.

(56) References Cited

U.S. PATENT DOCUMENTS

| | | | | |
|---|---|---|---|---|
| 6,260,721 | B1 * | 7/2001 | Ohmi | B65D 41/485 215/256 |
| 6,360,908 | B1 * | 3/2002 | Kline | B65D 51/18 220/257.1 |
| 2005/0121451 | A1 * | 6/2005 | Van Bruggen | B65D 39/082 220/257.2 |

FOREIGN PATENT DOCUMENTS

| | | | |
|---|---|---|---|
| EP | 0 307 169 | A1 | 3/1989 |
| EP | 0 725 013 | A1 | 8/1996 |
| WO | 2005/056411 | A1 | 6/2005 |
| WO | 2005/056412 | A1 | 6/2005 |
| WO | 2008/139196 | A1 | 11/2008 |

* cited by examiner

*Primary Examiner* — James N Smalley
(74) *Attorney, Agent, or Firm* — Baker & Hostetler LLP

(57) ABSTRACT

A tamper indicating closure cap or overseal comprises a top wall, and an annular top wall skirt attached to a periphery of the top wall. A locking member is attached to the top wall skirt so as to be movable between:

i) a first position projecting inwardly with respect to the top wall for application of the closure cap or overseal to a container opening and/or to a container closure plug and ii) a second position projecting inwardly and upwardly towards the top wall, thereby to lock the closure cap or overseal to the container closure and/or closure plug.

8 Claims, 2 Drawing Sheets

CONTAINER CLOSURE CAP AND CONTAINER CLOSURE

This invention is directed to caps or overseals for container closures and is principally, but not exclusively, directed towards closure caps or overseals for smaller sized openings in drums or similar shipping containers, such as those closed by a ¾ inch (19.05 mm) plug.

It has long been the practice to apply overseals of one kind or another with special hand and power tools which were able to crimp a metal portion of the overseal tightly around an upstanding opening neck designed to receive the seal. The application step itself is quite labour intensive and relatively inefficient. Consequently a number of hand applied overseals or closure caps have come forth which to a certain degree obviate the above-mentioned application tools. Our prior patent specifications WO2005/056411, WO2005/056412 and WO2008/139196 concern closure caps intended for application by hand, without the aid of special tools. To be effective such closure caps or overseals need to meet a number of rather demanding criteria. Obviously the hand application has to be simple and relatively effortless to satisfy normal filling line speeds. Once the drum or other container is shipped, of paramount importance is the ability of the cap or overseal to guard against unauthorized access to the drum contents. This means that ideally the cap or overseal cannot be physically removed without destroying it or making unauthorized access clearly noticeable such that the cap or overseal cannot be reapplied in unaltered form to the drum closure.

The caps or overseals must be of sufficiently robust construction so that they (and in particular their tamper indicating features) are not destroyed by the normal handling of the shipping containers or drums to which they are attached. Tamper indicating features which are destroyed or damaged in this way will give a false positive tamper indication. A performance criterion also of major importance is the ease with which the cap or overseal can be removed from the underlying container (e.g. drum) closure in an authorised manner such that subsequent replacement of the overseal is not possible. As this requires destruction of the cap or overseal in some fashion to prevent reuse this therefore to some extent conflicts with the requirement for robustness. In this regard the use of sharp cutting or puncturing implements is undesirable due to the likelihood injury or of accidental damage to the underlying closure. Thus, in addition to the overseal's robust construction, hand removability is yet another advantageous attribute.

WO2005/056411 and WO2008/139196 disclose closure caps intended for use together with specially modified complementary plastics closure plugs or bungs for shipping containers. The closure caps concerned have attachment portions which engage with an undercut groove formed in specially modified wrench-engaging lugs integrally moulded in the plug. These closure caps work well with two inch (50.8 mmm) and similarly sized closure plugs. However when attempting to "miniaturize" these styles of closure cap or overseal for use with a ¾ inch (19.05 mm) or similarly smaller sized plugs, the attachment portion becomes small and fragile, such that it can no longer provide reliable retention of the closure cap on the plug, nor reliable tamper indication.

WO2005/056412 discloses a closure cap which is suitable for retention by fitment to a peripheral groove formed about the neck of a filling opening of a shipping container or drum, or formed about a projecting part of the plug, or formed between a projecting part of the plug and the underlying neck of the container opening. However, as there is a lack of standardization both in container necks and in plugs with projecting parts, a "one size fits all" overseal of the style shown in WO2005/056412 is not possible. Also, with this style of overseal, there is a trade-off between ease of fitment and tamper resistance. The overseals concerned rely on a radially inwardly projecting ridge or bead for their retention. A sharply radiussed or substantially unradiussed bead provides greater resistance to removal and hence better tamper resistance. But in general it also requires greater axially applied force to snap-fit it to the peripheral groove. On the other hand, a generously radiussed bead makes fitment of the overseal to the peripheral groove easier, but at the same time makes the overseal less secure or tamper proof. In other words, "easy on, easy off".

EP0307169 (Kerr Glass manufacturing Corporation) discloses a tamper-evident cap for a wide mouthed, open topped container such as a glass jar. The cap is a one-piece plastics moulding having an internally threaded annular skirt. A tamper-evidencing band is spaced from the lower rim of the skirt by a number of frangible bridges. Immediately as moulded. a segmented ring is connected to the bottom of the band, with adjacent segments of the ring separated by axially extending slots. A number of resilient tabs are provided which extend axially from the distal edges of the segments. Prior to installation of the cap on a container, the segments and their attached tabs are folded inwardly and everted so that the tabs and segments extend inwardly and upwardly within the skirt, such that they can pass over and jam beneath a breaker ledge formed about the container neck finish.

EP0725013 (Lawson Mardon Sutton Limited) concerns a tamper-evident cap for a keg spear. The cap includes resilient teeth somewhat similar in their overall retaining function to the tabs of EP0307169 just described. However the cap also has a tamper-evident ring connected about the cap skirt by radial tags providing point-to-point attachments between the tamper-evident ring and skirt. The teeth are moulded in situ to extend from the cap skirt inwardly and upwardly, so as to jam beneath an annular, outwardly extending ridge provided about the keg spear. This requires the provision of moulding access apertures in a top wall of the cap, which can allow the ingress of dirt and other contaminants, compromising the cap's ability to shield against contamination and corrosion. Providing evertable segments and tabs instead of the teeth, as taught by EP0307169, would be difficult; as access to these components for full eversion during manufacture of the cap or prior to use is hampered by the delicately attached tamper-evident ring.

Thus there remains a need for a closure cap or overseal for use with smaller-sized container openings and plugs, which is relatively easy to fit and relatively reliable in providing tamper-resistance.

Accordingly, the present invention provides a tamper indicating closure cap or overseal comprising:

- a top wall
- an annular top wall skirt attached to a periphery of the top wall;
- a tamper-detecting band radially spaced from and overlying the top wall skirt;
- a frangible connection between the tamper-detecting band and the top wall skirt; and
- a locking member attached to the top wall skirt so as to initially project inwardly and downwardly with respect to the top wall for engagement with a container opening and/or with a container closure plug;

the locking member being movable by such engagement to a position projecting inwardly and upwardly towards the top wall, thereby to lock the closure cap or overseal to the container closure and/or closure plug. Such an arrangement may be used to provide an overseal or closure cap which is relatively small in size, robust (and therefore reliable in tamper detection/indication) and relatively easy to apply in comparison to prior designs.

Preferably the locking member moves to the inwardly and upwardly projecting position with snap action, as the closure cap is fitted to the container opening and/or closure plug. This may allow for easy fitment and secure retention.

Preferably a plurality of the locking members are provided, circumferentially distributed about the top wall skin. This again may allow for easy fitment and secure retention of the closure cap or overseal on the container opening and/or on the closure plug.

Advantageously, the top wall and/or the top wall skirt comprises a frangible portion allowing the top wall skirt to be radially expanded for more readily disengaging the locking member from the container opening and/or the closure plug, and to provide tamper indication.

Advantageously, the frangible portion comprises a line of weakness extending across the top wall skirt, generally axially of the closure cap or overseal. Additionally or alternatively, the line of weakness may extend in or into the top wall.

Additionally or alternatively, the top wall and top wall skirt may have tamper evidencing features per se similar to those of the closure cap disclosed in WO2005/056412. Thus the top wall and top wall skirt may comprise:

a) a line of weakness extending up the top wall skin and/or in or into the top wall, and b) a bridging element securely joining the tamper-detecting band and the top wall skirt in the region of the line of weakness. With this arrangement, the band may be used as a handle to more easily rupture the line of weakness. At the same time, the frangible connection is easily broken if any attempt is made to lever off the tamper indicating closure cap or overseal from the closure plug or container opening. The tamper detecting band can be arranged and configured so that its lower edge lies closely adjacent to a surface of the container or container opening, such that it is difficult to gain a purchase between them with a levering tool, without marking the band and/or container/container opening, and/or without breaking the frangible connection. The tamper-detecting band may project axially beyond a lower edge of the annular top wall skirt. Therefore it may be fitted closely about and radially outward of a filler neck forming the container opening, while the lower edge of the top wall skirt is positioned closely adjacent to an end face of the container filler neck. In this position, both the tamper-detecting band and the annular top wall skirt prevent ready access to the locking member for levering the closure cap out of engagement with the filler neck and/or with a closure plug received therein.

The invention correspondingly provides, in combination,

A) a tamper indicating closure cap or overseal as described above, and

B) a container closure plug and/or a container opening.

Preferably the locking member comprises a distal portion configured such that in the inwardly and upwardly projecting position the distal portion lockingly engages within a recess provided within the container closure plug, or within the container opening, or between the container closure plug and the container opening.

Preferably the combination comprises a plurality of the locking members circumferentially distributed about the top wall skirt, and the recess comprises an annular groove formed about the container closure plug, about the container opening, or between the container closure plug ad the container opening.

The invention and some of its preferred features and advantages are further described below with reference to an illustrative embodiment shown in the drawings.

BRIEF DESCRIPTION OF THE DRAWINGS

Referring to FIGS. 1-3, there is shown a tamper indicating closure cap or overseal 10 having a top wall 12. A top wall skirt 14 is integrally moulded with and peripherally depends from the top wall 12. A series of leaf or petal shaped locking members 16 are provided, circumferentially distributed about the distal or free lower edge of the top wall skirt 14. Each locking member is attached to the top wall skirt lower edge via a respective thinned section 17, forming a resilient web or living hinge. In their relaxed or immediately as-moulded condition, the locking members extend inwardly and downwardly from the top wall skirt 14 edge, in a first position as shown in FIGS. 1-3.

Figure 1:
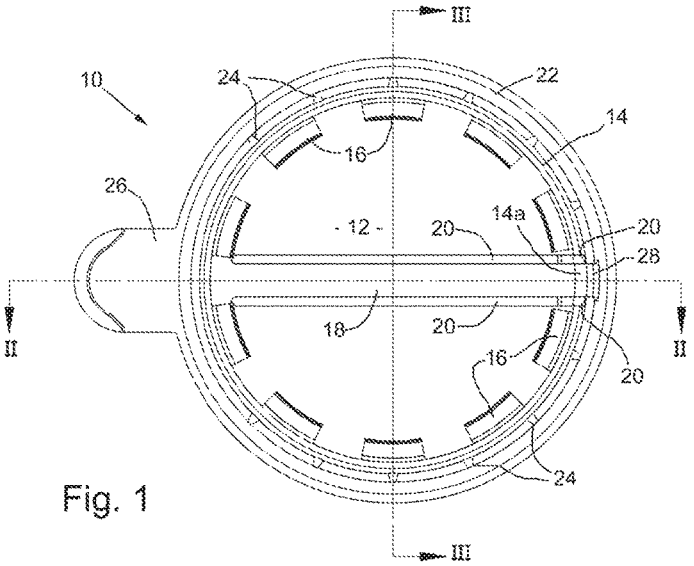
FIG. 1 shows an underplan view of a closure cap or overseal embodying the invention.

The top wall 12 and top wall skirt 14 comprise a frangible portion 18. This takes the form of a tear strip whose rupturable edges are defined by a parallel pair of lines of weakness 20 which run generally axially across the top wall skirt 14 and into the top wall 12. The lines of weakness 20 continue from the top wall skirt across the top wall, substantially to the diametrically opposite side of the top wall 12, but terminate there just short of the top wall skirt 14. The lines of weakness 20 may be grooves (as shown) to reduce the thickness of the top wall 14 and top wall skirt 14. The grooves are preferably formed on the inside surfaces of the top wall and top wall skirt so as to leave the outer surfaces of the cap 10 substantially smooth and uninterrupted. This provides fewer external crevices for dirt accumulation. The uninterrupted top wall outer surface is also optimised for receiving printed graphics, such as logos or information concerning the container contents or their properties or use. The uninterrupted top wall also provides effective shielding of the container opening and closure plug against contaminants and corrosion.

A tamper-detecting band 22 is radially spaced from and overlies the top wall skirt 14. The tamper-detecting band is frangibly connected to the top wall skirt by a series of circumferentially spaced breakable pin connections 24, integrally moulded with the top wall skirt 14 and the tamper-detecting band. The entire cap or overseal 10 may thus be formed for example as a one-piece injection moulding in any suitable material, preferably a polymer such as LDPE or HDPE. A tear tab 26 shaped to be easily gripped between a user's finger and thumb or by a removal tool such as a pair of pliers, extends radially from a lower edge of the tamper-indicating band 22. The tear tab 26 is located on the circumference of the tamper-indicating band 22 at the point closest to where the lines of weakness 20 (and hence the tear strip 18) terminate in the top wall 12.

Figure 1A:
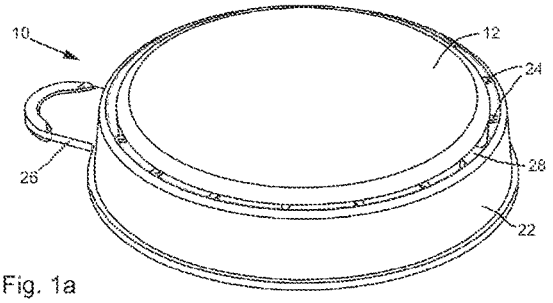
FIG. 1*a* is a perspective view from above and one side, of the closure cap/overseal of FIG. 1.
Figure 2:
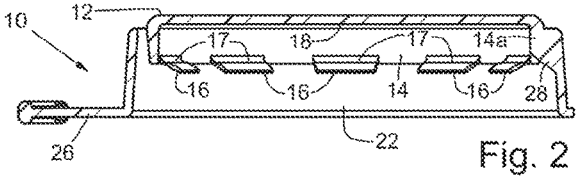
FIG. 2 is a sectional view in line II-II in FIG. 1.

As best seen in FIGS. 1, 1*a* and 2, a bridging element 28 securely joins the tamper-detecting band 22 to the portion 14*a* of the top wall skirt 14 lying between the lines of weakness or grooves 20. The bridging element 28 is sufficiently strong to form a permanent connection between the tamper-detecting band and the top wall skirt portion 14*a*. This permanent connection remains intact when the lines of weakness 20 are ruptured (as further described below), so that the tamper-detecting band 22 remains attached to the tear strip 18.

Figure 4:
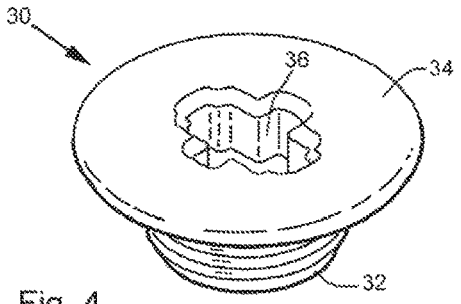
FIG. 4 is a perspective view from above and one side of a container closure plug for use in combination with the closure cap of the preceding Figures.
Figure 5:
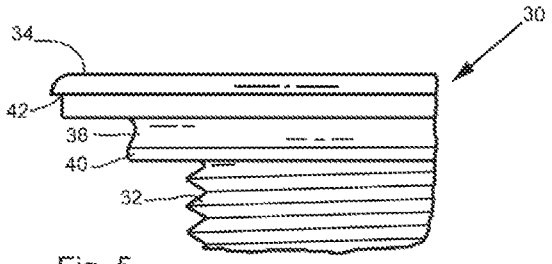
FIG. 5 is a scrap view showing a portion of the plug of FIG. 4 in more detail.

FIGS. 4 and 5 show a container closure plug 30 adapted to co-operatively receive the cap or overseal 10 of the preceding Figures. The closure plug 30 as shown is of relatively small size, e.g. ¾ inch (19.05 mm), as may be used for example as a vent plug for drums and similar shipping containers for liquids. The plug may be made from any suitable material, e.g. injection moulded plastics as shown. Other suitable materials/fabrication methods include die cast or pressed metal, as is well known. The plug 30 has an externally threaded, generally cylindrical body 32 adapted to be screwed into an internally threaded container neck or container insert flange, again as is conventional. The outer or upper end of the plug is extended radially outwards to form a disc-shaped upper rim 34. A central depression 36 extends from the upper face of the rim 34, axially into the plug body 32. The depression 36 has a non-round cross-section, engageable by a wrench or key of complementary shape (not shown). Drive torque may thus be applied for screwing the plug 30 into, or unscrewing the plug 30 from, the container neck. The remaining upper face of the rim 34 is sufficiently broad to carry printed or embossed lettering or graphics. When embossed, the lettering or graphics is preferably sub-flush with respect to the plug rim upper face, making it more difficult to use this embossing for the application of drive torque for the unauthorised removal of the plug 30; particularly when the cap or overseal 10 is in place, as further described below.

Figure 7:
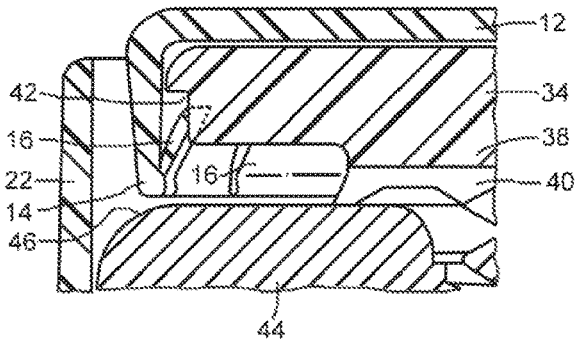
FIG. 7 is a scrap view showing a part of FIG. 6 in greater detail.

Referring now mainly to FIGS. 5 and 7. an elastomeric sealing gasket 40 is shown insert moulded onto a lower side of the plug rim 34 so as to surround the plug body 32. Alternatively, the sealing gasket 40 may be a separate component, stretched onto the plug body so as to be held in place between an upper end of the plug thread and the lower face of the plug rim 34. The sealing gasket 40 lies adjacent to a radially inwardly stepped energising portion 38 of the plug rim 34, which compresses the sealing gasket 4 axially against an upwardly facing portion 46 of the container neck 44 as the plug is tightened. The height or thickness of the gasket 40 may be smaller than gaskets commonly used with existing ¾ inch (19.05 mm) plastics plugs for drums and shipping containers; for example 0.030 inches (0.76 mm) as compared to 0.080 inches (2.03 mm). The overall stackup height of the plug 30 in combination with the fitted cap or overseal 10 may thus be comparable to or less than the height of a known plug, relative to the container or drum head, so that the plug/cap combination is not made more proud and therefore more vulnerable to accidental damage.

The bottom corner of the radially outermost part of the plug rim 34 is recessed to form an annular groove 42, with which the cap locking members 16 are snap-fittingly engageable, as further described below.

Figure 6:
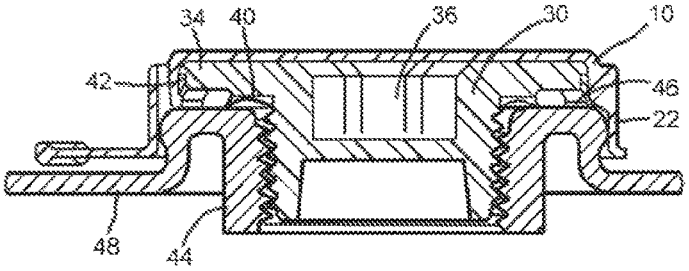
FIG. 6 is a schematic cross-section of the plug and cap of the preceding Figures, shown in place in and over a container opening.

Referring next to FIG. 6, the plug 30 is shown screwed into an internally threaded container opening or neck 44, e.g. formed in or fitted to a drum head 48 in known manner.

This takes place prior to fitment of the cap or overseal 10. so that the drive depression 36 is accessible by a suitable wrench or key, for tightening the plug to an appropriate torque. When the plug is properly tightened in the container neck 44, the gasket 40 is axially compressed against the generally upwardly facing annular surface 46 of the container neck 46 to form a continuous, peripheral, fluid-tight seal with the container neck. Tightening the plug 30 to the correct torque ensures that the seal is complete but the gasket 40 is not over compressed or crushed. The gasket 40 and plug thread also engage the surface 46 and neck thread with sufficient frictional resistance to prevent the plug 30 from shaking loose under shock and vibration, as may be experienced during transportation of the container.

Figure 3:
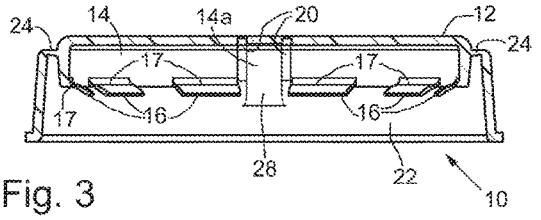
FIG. 3 is a sectional view on line II-III in FIG. 1.

Next, (and still referring to FIG. 6) the cap or overseal 10 is fitted to the plug 30. When the cap 10 is initially offered up to the plug 30, the locking members 16 are in their downwardly and inwardly extending first position (see FIGS. 2 and 3) and encounter the upper surface of the plug rim 34. As the cap 10 continues to be pushed downwards onto the plug 30, the locking members are resiliently bent or pivoted upwardly, at first further inwardly, until they point essentially radially inward. Then continued downward pressure on, and movement of, the cap causes the plug rim 34 to push or pivot the locking members 16 resiliently upwardly and outwardly, until the outer circumference of the plug rim 34 is able to pass between the tips of diametrically opposing locking members 16. Continued downward movement of the cap or overseal 10 relative to the plug 30 then causes the recess or annular groove 42 to draw level with the tips of the locking members 16. At this point, the locking members 16 resiliently snap into position with their tips locked into the annular groove 42. Downward movement of the cap/overseal 10 onto the plug 30 stops when the inner surface of the top wall 12 encounters the upper surface of the plug rim 34, and/or when the lower edge of the top wall skirt 14 grounds out on the upper annular surface 46 of the container neck 44.

In this position (see FIGS. 6 and 7) the cap or overseal 10 is held for "loose" rotation on the plug 30 and container neck 44. The plug rim is loosely held for rotation in the top wall skirt 14, captive between the top wall 12 and the locking members 16. Therefore, anticlockwise rotation of the cap 10 will not apply sufficient driving torque to the plug 30 to overcome friction at the gasket 40 and threads 32, as would be required to unscrew the plug 30 from the container. Attempts to squeeze the top wall skirt 14 so as to radially engage the plug rim 34 will most likely result in visible damage to the tamper-detecting band 22 and breakage of at least some of the pin connections 24; as the tamper-detecting band 22 radially overlies and protects the top wall skirt 14. The top wall 12, top wall skirt 14 and tamper-detecting band completely prevent access to the plug 30 and locking members 16, including making the depression 36 inaccessible to a wrench or plug key.

Once the locking members 16 have snapped into place in the annular groove 42, the cap or overseal 10 is very difficult, if not impossible, to pull off the plug 30 without breaking. That is, the cap or overseal 10 forms a "one way" snap-fit connection with the plug 30. With the tips of the locking members 16 held in the groove 42, upward force on the cap/overseal causes the ends of the locking members attached to the top wall skirt 14 to try to rotate upwardly and outwardly. However, outward movement of these ends is constrained by hoop stress in the top wall skirt 14, with a substantial mechanical advantage. because the locking members lie with their axes substantially parallel to (or only at a shallow angle to) the plug/cap axis. Thus, once fitted, the cap/overseal 10 is very difficult to remove from the plug 30 by an upward pull.

The bottom edge of the tamper-detecting band 22 can be made to lie closely adjacent to the underlying drum head or container end surface 48, so that it is difficult to gain a purchase between the two with a levering tool. In some cases it may be necessary to provide a small clearance between the tamper-detecting band 22 and the drum head/container end surface 48 as shown in FIG. 6, so as to allow for variability in the neck 44 height dimension, e.g. as between different neck styles and manufacturers. Even so, any unauthorised attempt to lever off the cap will result in visible damage to the tamper-detecting band 22 and/or to the surface 48, and/or breakage of some or all of the pin connections 24. Similarly, the lower edge of the cap top wall skirt 14 may be dimensioned to lie closely adjacent to the upper annular surface 46 of the container neck 44.

When it is desired to gain legitimate access to the plug and container contents, first the tear tab is pulled upwardly and towards the opposite side of the cap or overseal 10. This breaks the pin connections 24 and separates the tamper-detecting band 22 from the top wall skirt 14, apart from at the bridging element 28. The tamper-detecting band 22 may then be used as a handle for rupturing the tear strip 18 along the lines of weakness 20. The pin connections 24 are at their thinnest immediately adjacent to the tamper-detecting band 22. so that the majority of each broken pin connection remains attached to the top wall skirt 14. This makes the tamper-detecting band free of sharp edges and therefore more comfortable to hold when being used as a handle for the tear strip 18. Rupturing the tear strip 18 almost separates the cap top wall 12 into two further pieces, one on either side of the tear strip 18. However, as the lines of weakness 20 terminate in the top wall just short of the top wall skirt 14, near to where the tear tab 26 used to be, the separated top wall portions and the tear strip remain connected together. The top wall pieces and associated top wall skirt portions nevertheless are now sufficiently movable relative to one another, to permit disengagement of the locking members 16 from within the plug rim annular groove 42. As the tamper-detecting band 22 remains attached to the tear strip 18 via the bridging element 28, the cap or overseal 10 may be lifted away from the plug 30 in one piece, for re-cycling. The plug can now be unscrewed, using the depression 36 as a drive formation. The pin connections 24 and the lines of weakness 20 are visibly broken, so that the cap 10 cannot be re-applied to the plug 30. But because the cap remains in one piece, there are no small parts to litter or pollute the environment or to fall into and contaminate the container.

The invention claimed is:

1. In combination,

A tamper indicating overseal comprising:

a top wall, an annular top wall skirt attached to a periphery of the top wall, a tamper-detecting band radially spaced from and overlying the top wall skirt, and a frangible connection between the tamper-detecting band and the top wall skirt and B. a threaded container closure plug received in a container opening and comprising:

a rotational axis about which the plug is rotated as it is screwed into or unscrewed from the container opening, and an annular groove formed about the rotational axis of the plug;

wherein the overseal further comprises a plurality of locking members attached to the top wall skirt and circumferentially distributed thereabout so as to initially project inwardly and downwardly with respect to the top wall for engagement of the overseal with the container closure plug;

the locking members being movable by such engagement to a second position projecting inwardly and upwardly towards the top wall, thereby to lock the overseal to the container closure plug;

wherein each locking member comprises a distal portion configured such that in the inwardly and upwardly projecting position of the locking member, the distal portion lockingly engages within the annular grooves so that the locking members lie with their axes substantially parallel or at the shallow angle to the rotational axis of the plug and thereby resist removal of the overseal from the plug.

2. The combination of claim 1, wherein the annular groove is formed in an upper part of the plug which projects outwardly from a lower part of the plug received in the container opening.

3. The combination of claim 1, wherein the container opening comprises a neck portion upstanding from a wall of the container and the tamper-detecting band projects axially beyond a lower edge of the top wall skirt, whereby the lower edge of the top wall skirt is positioned adjacent to an annular end fact of the neck portion, with a lower edge of the tamper-detecting band positioned adjacent to the wall of the container to surround the neck portion.

4. The combination of claim 1, in which:

the locking members move to the inwardly and upwardly projecting position with snap action, as the overseal is fitted to the container closure plug.

5. The combination of claim 1, in which:

the top wall and/or the top wall skirt comprises a frangible portion allowing the top wall skirt to be radially expanded for more readily disengaging the locking member from the container opening and/or the closure plug, and to provide tamper indication.

6. The combination of claim 5, in which:

the frangible portion comprises a line of weakness extending across the top wall skirt, generally axially of the overseal.

7. The combination of claim 5, in which:

the frangible portion comprises a line of weakness extending in or into the top wall.

8. The combination of claim 1, in which:

the top wall and top wall skirt comprise:

a) a line of weakness extending up the top wall skirt and/or in or into the top wall, and b) a bridging element securely joining the tamper-detecting band and the top wall skirt in the region of the line of weakness.

* * * * *